US005895343A

United States Patent [19]

Huang

[11] Patent Number: 5,895,343

[45] Date of Patent: Apr. 20, 1999

[54] UPPER OR LOWER BODY TRAINER

[76] Inventor: Chin-Lien Huang, 2F, No. 14, Ning Hsia E. 5 St., Taichung, Taiwan

[21] Appl. No.: 09/005,602

[22] Filed: Jan. 12, 1998

[51] Int. Cl.[6] ..... A63B 21/02

[52] U.S. Cl. ..... 482/123; 482/130

[58] Field of Search ..... 402/123, 129, 402/130

[56] References Cited

U.S. PATENT DOCUMENTS 5,603,681 2/1997 Olschansky et al. ..... 482/123

*Primary Examiner*—Lynne A. Reichard

*Attorney, Agent, or Firm*—Browdy and Neimark

[57] ABSTRACT

An exercise device is composed of a base, a frame body mounted on the base, a locating mechanism fastened pivotally with the frame body and composed of a first unit and a second unit, a damping unit fastened with the frame body, and a handle fastened with the first unit of the locating mechanism such that the handle is caused to turn an angle relative to the base at the time when the first unit is turned a predetermined angle in relation to the second unit for doing one of the muscular exercises of legs, belly, hips and arms.

9 Claims, 8 Drawing Sheets

UPPER OR LOWER BODY TRAINER

FIELD OF THE INVENTION

The present invention relates generally to an exercise device, and more particularly to a multi-functional device capable of exercising legs, belly, hips and arms of a person.

BACKGROUND OF THE INVENTION

The conventional exercise devices of various types are generally grouped into two categories in accordance with their training purposes. The conventional exercise devices of the first category are intended for muscular training and include the various devices of a weight-lifting nature, whereas the conventional exercise devices of the second category are mainly designed for endurance training and are composed of various devices such as a jogging machine, a body-building machine and so forth.

As far as the devices of the first category are concerned, they are generally aimed at the muscular build-up of a specific portion of a person's body. The case in point is a dumbbell for muscular exercise of a hand. The current evolutionary trend of the exercise device is the development of the multi-functional composite exercise devices capable of muscular exercise of various parts of a human body. However, the conventional multi-functional exercise devices are defective in design in that they are rather complicated in construction, and that they are rather cumbersome, and further that they take up too much of a floor space, and still further that they can not be easily shipped or stored.

SUMMARY OF THE INVENTION

It is therefore the primary objective of the present invention to provide a four-in-one training device which is intended to provide muscular exercises of legs, belly, hips and arms of a person and is simple in construction. The training device is versatile in operation such that it can be used for developing the muscles of various parts of a human body.

It is another objective of the present invention to provide a four-in-one exercise device which can be folded to facilitate the storage of the exercise device.

In keeping with the principle of the present invention, the foregoing objectives of the present invention are attained by the four-in-one training device consisting of a base, a frame body mounted on the base, a locating mechanism fastened pivotally with the frame and composed of a first unit and a second unit capable of a pivoting movement relative to the first unit and vice versa, a damping unit fastened at one end thereof with the frame and fastened movably at another end thereof with one end of the first unit, and a handle fastened with the second unit. As the first unit is turned an angle relative to the second unit, the handle is caused to turn in relation to the base such that the handle is located at a predetermined position for doing an intended exercise.

The foregoing objectives, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
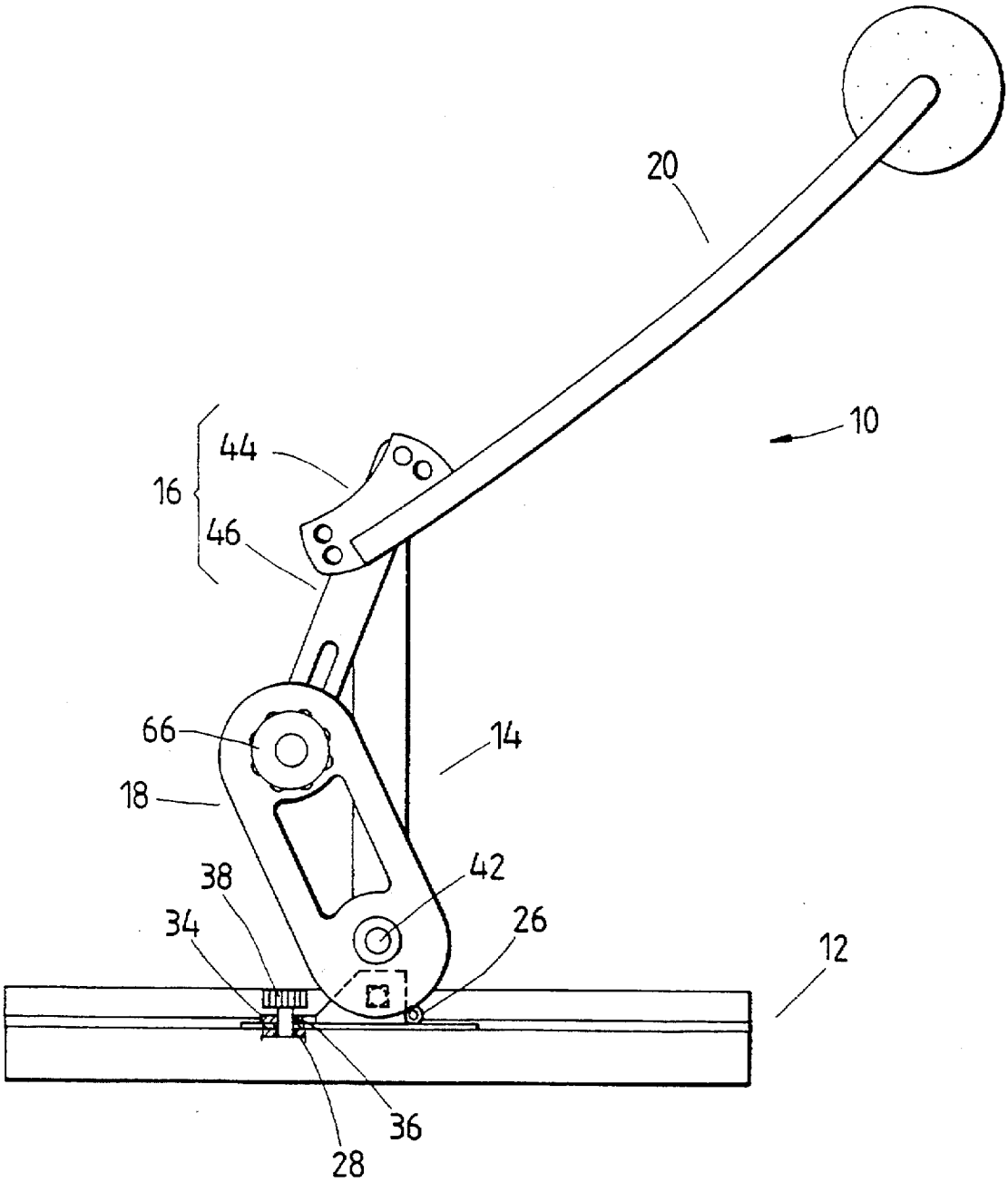
FIG. 1 shows a front view of the preferred embodiment of the present invention.
Figure 2:
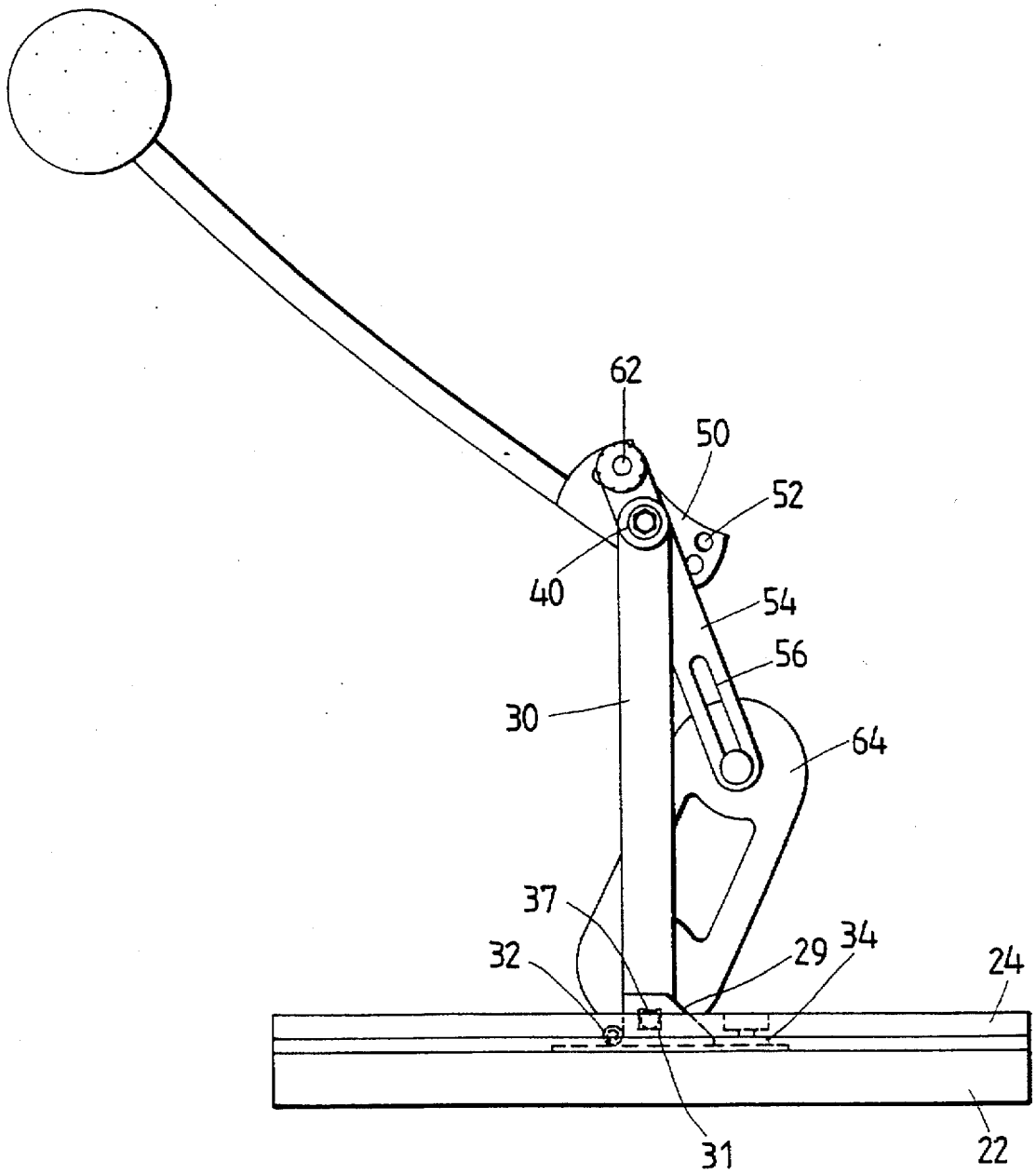
FIG. 2 shows a rear view of the preferred embodiment of the present invention.
Figure 3:
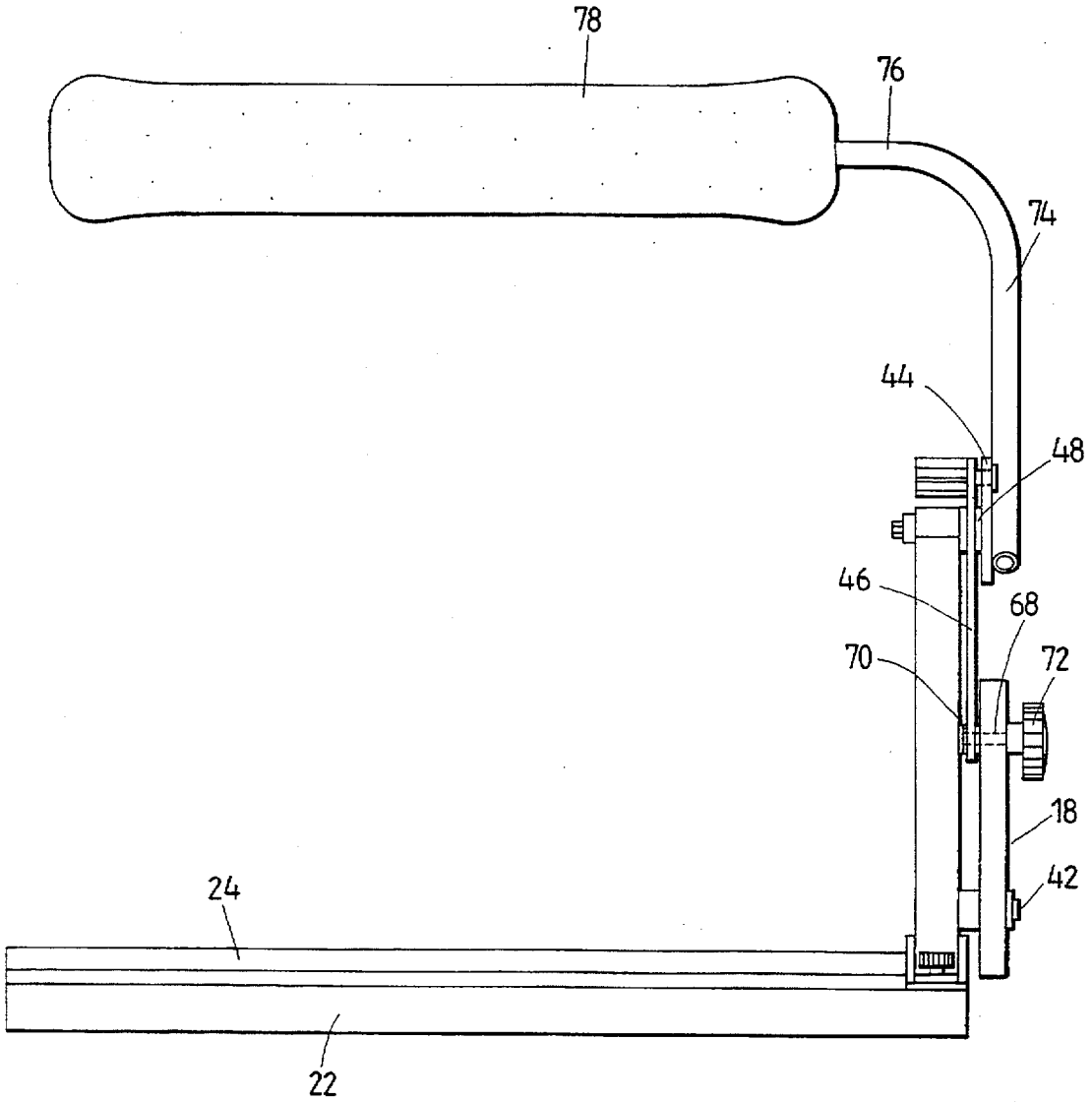
FIG. 3 shows a side view of the preferred embodiment of the present invention.
Figure 4:
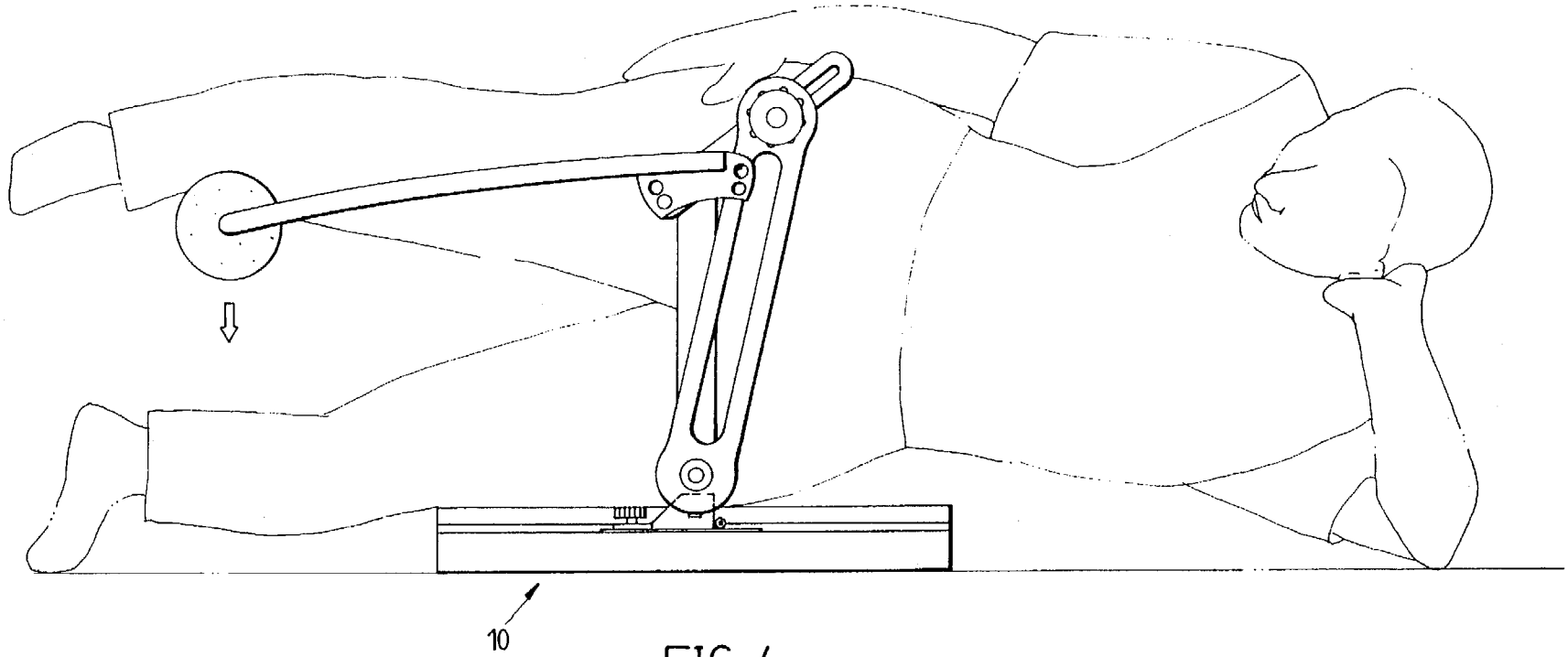
FIG. 4 shows a schematic view of the present invention at work for providing a leg muscular exercise.
Figure 5:
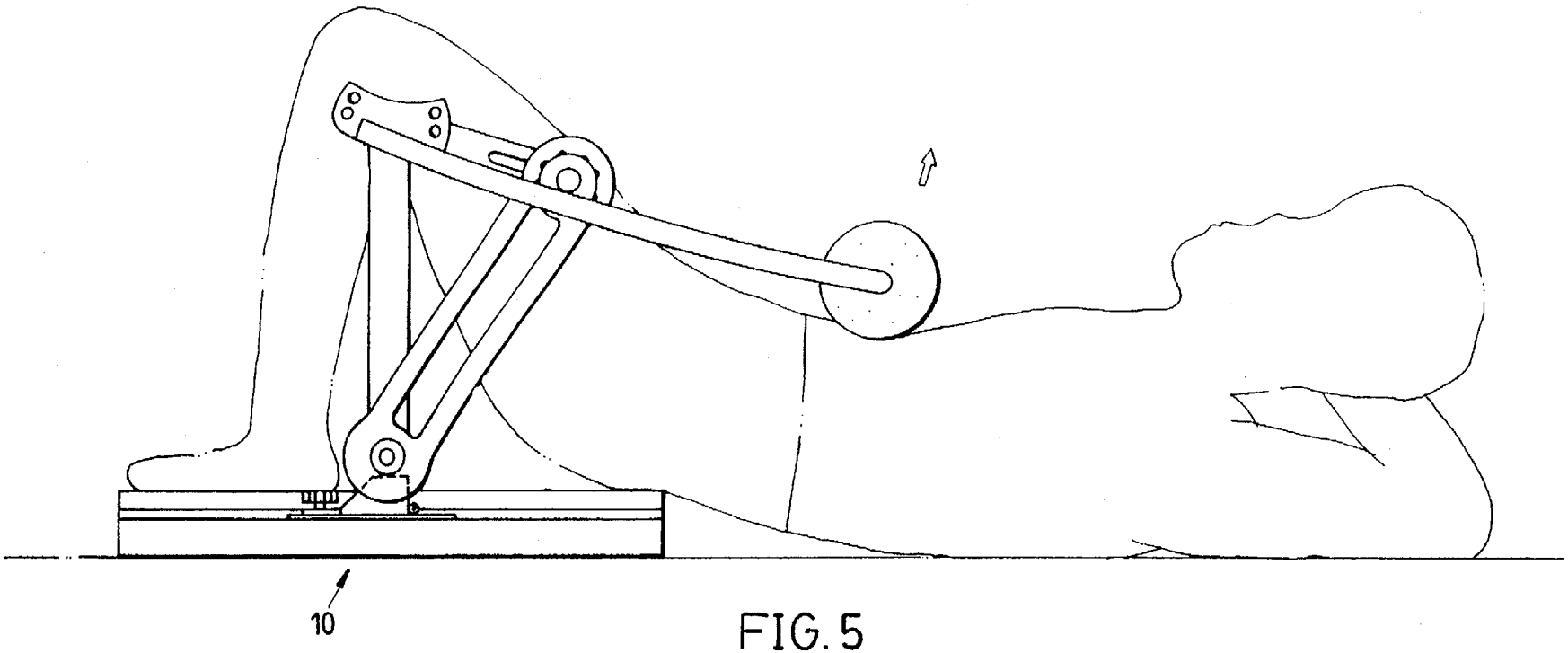
FIG. 5 shows a schematic view of the present invention at work for providing a belly muscular exercise.
Figure 6:
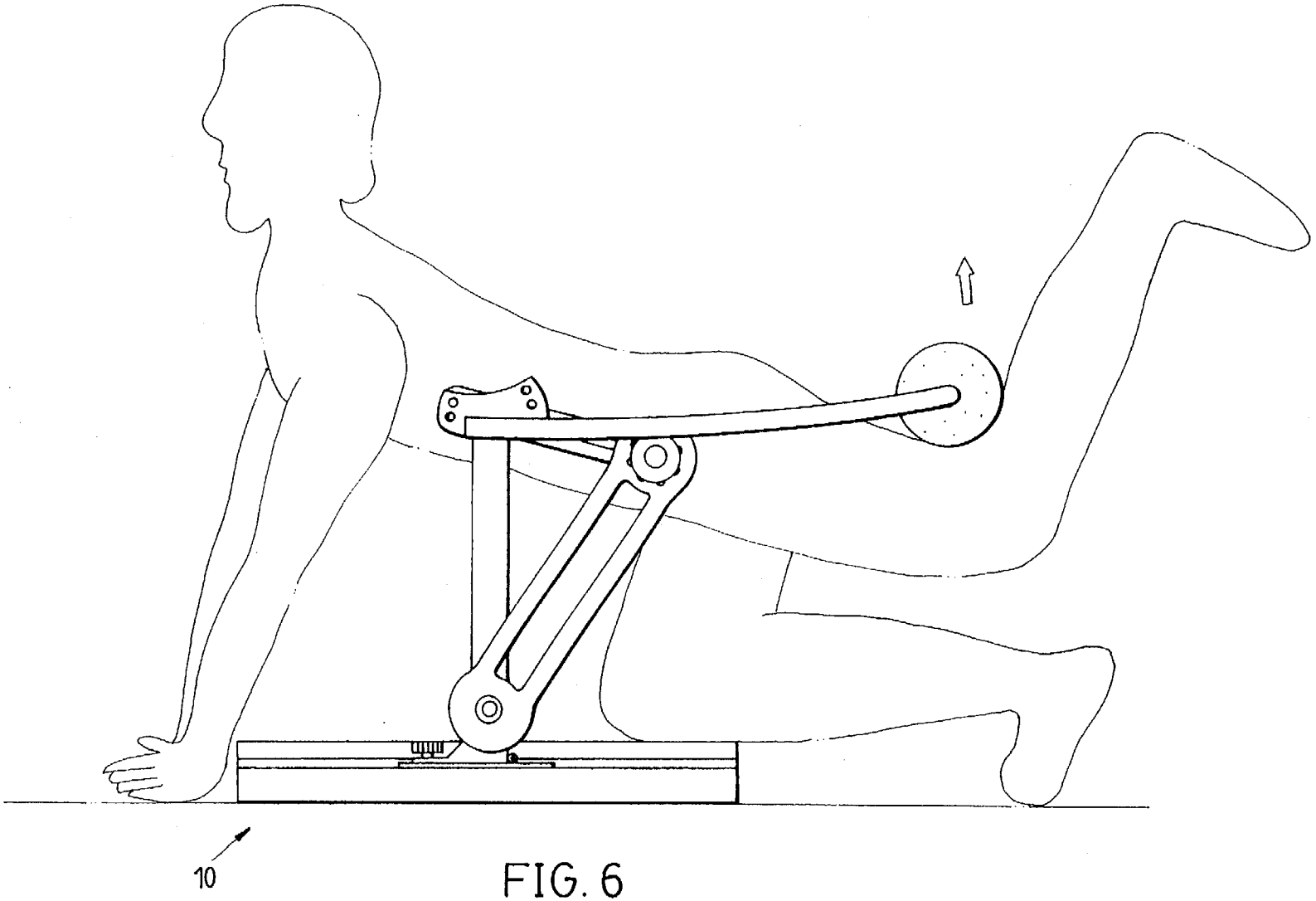
FIG. 6 shows a schematic view of the present invention at work for providing a hip muscular exercise.
Figure 7:
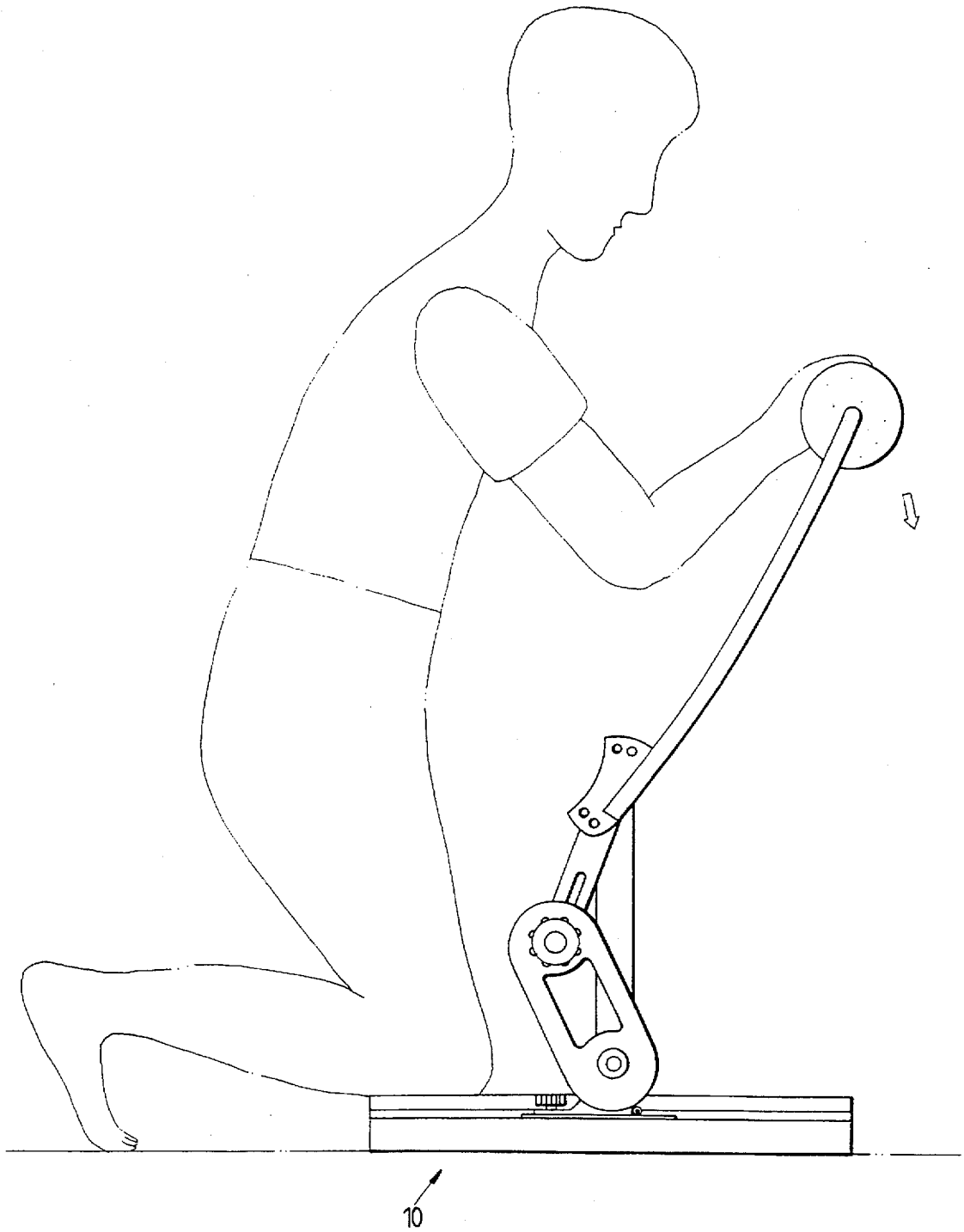
FIG. 7 shows a schematic view of the present invention at work for providing an arm muscular exercise.

As shown in FIGS. 1–3, an exercise device 10 embodied in the present invention is composed of a base 12, a frame body 14, a locating mechanism 16, a damping unit 18, and a handle 20.

The base 12 has a bottom frame 22, and a carrying plate 24 mounted on the bottom frame 22 which has one side jutting out of the carrying plate 24. The bottom frame 22 is provided with two first pivoting portions 26 mounted thereon at an interval, a fastening portion (a threaded hole) 28, and two first connection portions 29 mounted thereon and provided respectively with a through hole 31.

The frame body 14 has a rod 30, and a second pivoting portion (not shown in the drawings) located at the outer side of the bottom end of the rod 30 for fastening pivotally a pivoting rod 32 with the first pivoting portions 26. The rod 30 is provided at another side of the bottom end thereof with a protuberance 34 and is further provided at the bottom end thereof with a second connection portion (a through hole, not shown in the drawings) for fastening pivotally a locating rod 37 with the first connection portion 29. The protuberance 34 is provided with a second fastening portion (a threaded hole) 36, which is engaged with a bolt 38 which is in turn engaged with the second fastening portion 28 for erecting the frame body 14 on the bottom frame 22. The rod 30 is further provided at the top end thereof with a third pivoting portion 40, and at the outer side of the bottom end thereof with a fastening portion 42.

The locating mechanism 16 has a first unit 44, a second unit 46, and a partition 48 located between the first unit 44 and the second unit 46. The first unit 44 is composed of a main body 50, a shaft pin (not shown in the drawings) fastened with the center of the main body 50. The main body 50 are provided at both ends thereof with four locating portions (round holes) 52. The second unit 46 is composed of a base portion 54 provided at one end thereof with a round hole (not shown in the drawings) and a movable locating pin 62, and at another end thereof with a second locating portion (a slot) 56. The partition 48 is of a circular shape and an appropriate thickness. The first unit 44 of the locating mechanism 16 is fastened pivotally with the third pivoting portion 40 of the frame 14 by means of the shaft pin which is put through the partition 48 and the round hole of the second unit 46.

The damping unit 18 is composed of a damping member 64 which is fastened at one end thereof with the fastening portion 42 of the frame body 14, a fastening member 66 provided with a bolt 68 which is received in the second locating portion 56, a coil spring 70 located between the head of the bolt 68 and the base portion 54, and a rotary button 72 fastened with the tail end of the bolt 68 and located at another side of the base portion 54.

The handle 20 is composed of a vertical portion 74 and a horizontal portion 76. The vertical portion 74 is fastened at one end thereof with the main body 50, whereas the horizontal portion is extended vertically and outwardly from another end of the vertical portion 74 and is provided at the outer side thereof with an elastic jacket 78.

The fastening portion 62 of the exercise device 10 can be located on the first locating portion 52 so as to enable the handle 20 to be turned an angle relative to the base 12. In addition, the fastening member 66 can be displaced along the second locating portion 56 so as to alter the length of the damping member 64, thereby resulting in an increase or decrease in the damping force. As a result, the exercise device 10 of the present invention can be used interchangeably for doing the muscular exercises of legs, belly, hips, and arms, as illustrated in FIGS. 4–7.

Figure 8:
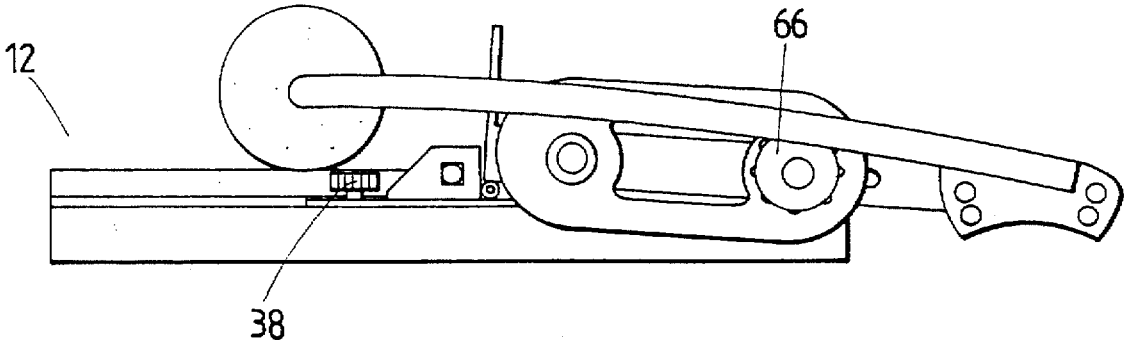
FIG. 8 shows a schematic view of the present invention in a compact state.

As shown in FIG. 8, the exercise device 10 of the present invention can be folded such that the frame body 14 is horizontally placed on the base 12 after the bolt 38 is disengaged by unfastening the fastening portion 62 and the fastening member 66. Upon completion of the folding of the exercise device 10 of the present invention, the bolt 38 is engaged with the first fastening portion 28. The exercise device 10 of the present invention is thus made so compact that it can be kept neatly in a small space.

The embodiment of the present invention described above is to be regarded in all respects as being merely illustrative and not restrictive. Accordingly, the present invention may be embodied in other specific forms without deviating from the spirit thereof. For example, the first unit and the second unit of the present invention may be modified such that they are capable of turning in relation to each other and of locating at a plurality of sections. In addition, the damping unit may be modified such that it is capable of locating at a plurality of sections on the second unit for bringing about a change in the damping force. The present invention is therefore to be limited only by the scopes of the following appended claims.

What is claimed is:

1. An upper or lower body trainer comprising:

a base;

a frame body mounted on said base;

a locating mechanism fastened pivotally with said frame body and composed of a first unit and a second unit capable of turning and locating in relation to said first unit and vice versa;

a damping unit fastened at one end thereof with said frame body and fastened movably at another end thereof with one end of said second unit;

a handle fastened with said first unit such that said handle is caused to turn an angle relative to said base at the time when said first unit is turned a predetermined angle in relation to said second unit;

wherein said base is composed of a bottom frame and a carrying plate fastened with said bottom frame and said frame body is fastened at one end thereof with one side of said bottom frame; and wherein said bottom frame is provided with two pivoting portions, a first fastening portion separated from said first pivoting portions by a distance, said frame body being provided at a bottom thereof with a second fastening portion corresponding in location to said first fastening portion; and wherein said frame body is fastened with said bottom frame by a bolt engaged with said first fastening portion and said second fastening portion.

2. The trainer as defined in claim 1, wherein said bottom frame is further provided with a first connection portion; and wherein said frame body is provided at a bottom thereof with a second connection portion engageable with said first connection portion.

3. The trainer as defined in claim 1, wherein said frame body is provided at a top thereof with a third pivoting portion for fastening pivotally said locating mechanism.

4. The trainer as defined in claim 1, wherein said first unit and said second unit are provided therebetween with a partition.

5. The trainer as defined in claim 1, wherein said first unit consists of a main body fastened pivotally with said frame body and provided with a plurality of locating portions separated from one another by a distance; and wherein said second unit consists of a base portion fastened pivotally with said frame body at an interval from said first unit and provided at one end thereof with a fastening portion corresponding in location to said locating portions, said base portion further provided at another end thereof with a second locating portion corresponding in location to one end of said damping member.

6. The trainer as defined in claim 5, wherein said first locating portions are round holes arranged arcuately on said main body.

7. The trainer as defined in claim 5, wherein said second locating portion is a slot.

8. The trainer as defined in claim 5, wherein said damping unit consists of a damping member fastened at one end thereof with a bottom of said frame body, and a fastening member located at another end of said damping member such that said fastening member is corresponding in location to one end of said second unit.

9. The trainer as defined in claim 8, wherein said fastening member is fastened at one end thereof with said second locating portion of said second unit.

* * * * *